US005534744A

United States Patent [19]

Leroux et al.

[11] Patent Number: 5,534,744

[45] Date of Patent: Jul. 9, 1996

[54] MICROPOINT EMISSIVE CATHODE ELECTRON SOURCE AND FIELD EMISSION-EXCITED CATHODOLUMINESCENCE DISPLAY MEANS USING SAID SOURCE

[75] Inventors: Thierry Leroux, IFS; Robert Meyer, St. Ismier, both of France

[73] Assignee: Commissariat a l'Energie Atomique, Paris, France

[21] Appl. No.: 337,528

[22] Filed: Nov. 8, 1994

Related U.S. Application Data

[63] Continuation of Ser. No. 22,935, Feb. 26, 1993, abandoned.

[30] Foreign Application Priority Data

Feb. 26, 1992 [FR] France ..... 92 02220

[51] Int. Cl.[6] ..... G09G 3/10

[52] U.S. Cl. ..... 313/309; 313/497; 345/74

[58] Field of Search ..... 313/309, 336, 313/351, 495, 496, 497, 485, 422, 360.1; 345/74

[56] References Cited

U.S. PATENT DOCUMENTS

| | | | |
|---|---|---|---|
| 4,874,981 | 10/1989 | Spindt | 313/309 |
| 5,075,591 | 12/1991 | Holmberg | 313/495 |
| 5,194,780 | 3/1993 | Meyer | 313/309 |
| 5,216,324 | 6/1993 | Curtin | 313/495 |

FOREIGN PATENT DOCUMENTS

| | | |
|---|---|---|
| 0461990 | 12/1991 | European Pat. Off. . |
| 2650119 | 1/1991 | France . |
| WO89/11157 | 11/1989 | WIPO . |

*Primary Examiner*—Richard Hjerpe
*Assistant Examiner*—Lun-Yi Lao
*Attorney, Agent, or Firm*—Burns, Doane, Swecker & Mathis

[57] ABSTRACT

Micropoint emissive cathode electron source and field emission-excited cathodoluminescence display means using said source. The source comprises a series of electrodes (5) acting as cathode conductors and carrying micropoints (12) and a series of electrodes (10*g*) acting as grids, each of the electrodes of one of the series being in contact with a resistive layer (7) and having a lattice structure, so that there are consequently tracks (5*a*) which intersect and define first openings (6), each of the electrodes of the other series having second openings (11) which are displaced with respect to the first openings.

7 Claims, 5 Drawing Sheets

MICROPOINT EMISSIVE CATHODE ELECTRON SOURCE AND FIELD EMISSION-EXCITED CATHODOLUMINESCENCE DISPLAY MEANS USING SAID SOURCE

This application is a continuation of application Ser. No. 08/022,935, filed Feb. 26, 1993 now abandoned.

BACKGROUND OF THE INVENTION

The present invention relates to an electron source having on an electrically insulating support a first type of parallel electrodes serving as cathode conductors and carrying a plurality of micropoints made from an electron emitting material, a second series of parallel electrodes serving as grids and which are electrically insulated from the cathode conductors and forming an angle therewith, which defines intersection zones between the cathode conductors and the grids, each of the electrodes of one of the series being in contact with a resistive layer and having a lattice structure, thus having tracks which intersect and define first openings, whereby each of the electrodes of the other series is discontinuous and consequently has second openings.

The invention more particularly applies to the display field and more specifically to flat screens.

Micropoint emissive cathode electron sources are already known from the following documents:

(1) French patent application 86 01024 of 24, Jan. 1986 and corresponding to U.S. Pat. No. 4,857,161 , (2) French patent application 87 15432 of 6, Nov. 1987 and corresponding to U.S. Pat. No. 4,940,916 and (3) French patent application 90 07347 of 13, Jun. 1990.

In particular, document (3) discloses an electron source of the type referred to hereinbefore and whose electrodes consequently have a lattice structure.

An embodiment of this known electron source is diagrammatically shown in plan view in FIG. 1A and in sectional view in FIG. 1B, which is the section CC of FIG. 1A.

This known source has a matrix structure and comprises an e.g. glass substrate 2 and optionally on the latter a thin silica layer 4. On the latter is formed a series of electrodes in the form of parallel conductive strips serving as cathode conductors and constituting the columns of the matrix FIGS. 1A and 1B show one of these cathode conductors 5. The cathode conductors are in each case covered by a resistive layer 7. A silica electrically insulating layer 8 covers the resistive layers Above the insulating layer 8 is formed a series of electrodes, which ape also in the form of parallel conductive strips and whereof one appears in FIGS. 1A and 1B carrying the reference 10. These electrodes formed above the insulating layer 8 are perpendicular to the cathode conductors and serve as grids constituting the rows of the matrix structure.

The known source also has a plurality of micropoints forming elementary electron emitters.

In each of the intersection zones of the cathode conductors and the grids, the resistive layer 7 corresponding to said zone supports micropoints 12 and the grid corresponding to said zone has a hole 14 facing each of the micropoints 12. Each of the latter substantially adopts the shape of a cone, whose base rests on the resistive layer 7 and whose apex is level with the corresponding opening.

Obviously, the insulating layer 8 is also provided with openings 15 permitting the passage of the micropoints 12.

Moreover, each of the electrodes of one of the two series of electrodes has a lattice structure in contact with a resistive layer.

In the example shown in FIGS. 1A and 1B, each cathode conductor has said lattice structure and consequently has intersecting conductive tracks SA. Therefore each cathode conductor has openings 6 defined by the said tracks 5A. The micropoints occupy central regions of the lattice meshes.

The electrodes of the other series (the grids in the example shown) have a continuous structure (disregarding the small diameter holes 14 positioned facing the micropoints 12).

The use of electrodes having a lattice structure is aimed at minimizing the breakdown risks at the micropoints, by limiting the electric current therein, so as to prevent the formation of short-circuits between the rows and columns via said micropoints. However, the aforementioned known source whose characteristics have just been described suffers from a disadvantage. Thus, due to the defects which the insulating layer 8 may have, there is a short-circuit possibility in the overlap zones between the lattice electrodes and the continuous electrodes.

On referring to FIG. 1A it can be seen that the surface of the overlap zones is equal to the surface of the lattice structure electrodes.

The object of the present invention is to reduce short-circuit risks more than is possible in the known source and to this end proposes reducing the overlap zones of the two series of electrodes to an even greater extent than in the source known from (3).

SUMMARY OF THE INVENTION

More specifically, the source according to the present invention having the first series of electrodes and the second series of electrodes referred to hereinbefore, is characterized in that the second openings are displaced with respect to the first openings and are consequently positioned facing tracks of the lattice, the first and second openings consequently not being superimposed.

Obviously, the structure of each discontinuous electrode must be such that it permits the application of the electric field to the corresponding micropoints.

Moreover, preferably each discontinuous electrode is given as small a surface as possible and a structure which minimizes the overlap zones with the lattice structure electrode corresponding thereto.

Preferably, in order to further reduce the overlap zones with the lattice electrodes, the second openings (corresponding to the discontinuous electrodes) are positioned facing intersections of the tracks of the lattices.

According to a first embodiment of the source according to the invention, the electrodes having the lattice structure are electrodes of the second series of electrodes and the discontinuous electrodes are electrodes of the first series of electrodes.

According to a second embodiment, the electrodes having the lattice structure are electrodes of the first series of electrodes and the discontinuous electrodes are electrodes of the second series of electrodes.

The present invention also relates to a cathodoluminescence display means incorporating a micropoint emissive cathode electron source and a cathodoluminescent anode having a cathodoluminescent material layer, said means being characterized in that the source is in accordance with that according to the present invention.

Preferably, the resistive layer and the support on which is formed the first series of electrodes are at least partly transparent to the light emitted by the cathodoluminescent material under the impact of the electrons, so as to be able to observe said cathodoluminescent material through the support. This permits a significant improvement to the luminous efficiency of the means and consequently reduces the electric power consumption thereof.

In order to yet further increase the luminous efficiency, it is preferable for the cathodoluminescent cathode to incorporate an electrode able to reflect the light emitted by the cathodoluminescent material layer, the latter being formed on said electrode facing the second series of electrodes.

Finally, with a view to improving the contrast of the means under illumination (the cathodoluminescent material being observed through said support), it is preferable to give each of the electrodes of the first and second series of electrodes on a layer able to adsorb the light arriving from the exterior of the means. dr

DESCRIPTION OF THE DRAWING

The invention is described in greater detail hereinafter relative to non-limitative embodiments and with reference to the attached drawings, wherein.

DETAILED DESCRIPTION OF THE PREFERRED EMBODIMENTS

Figure 1A:
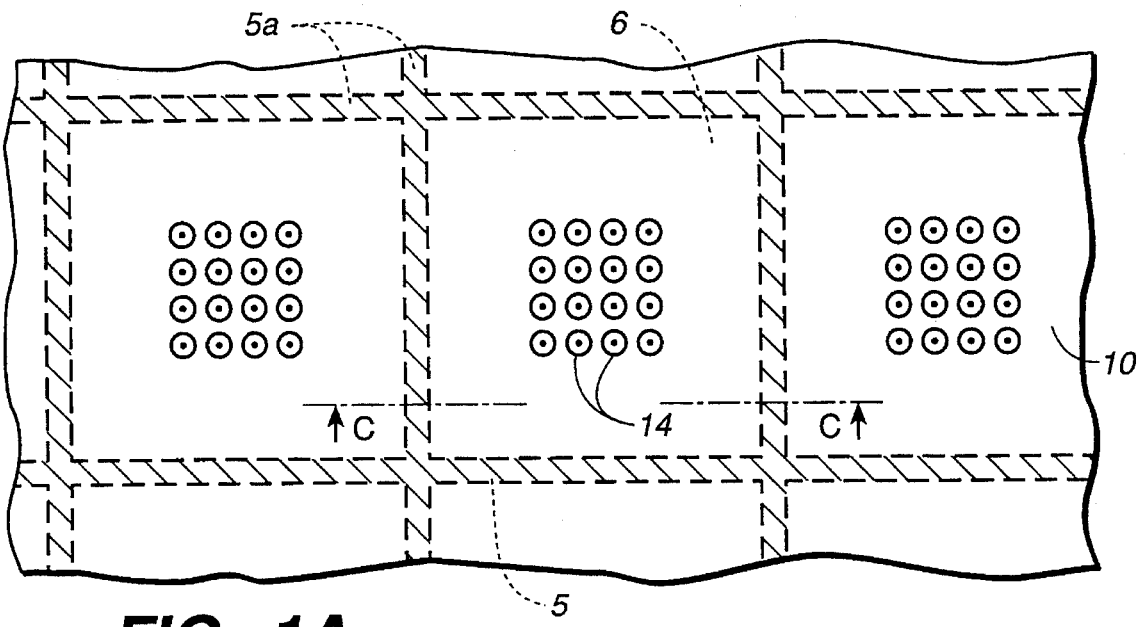
FIG. 1A (PRIOR ART)
FIGS. 1A and 1B are respectively, a diagrammatic plan view and a diagrammatic sectional view of a known electron source already described.
Figure 1B:
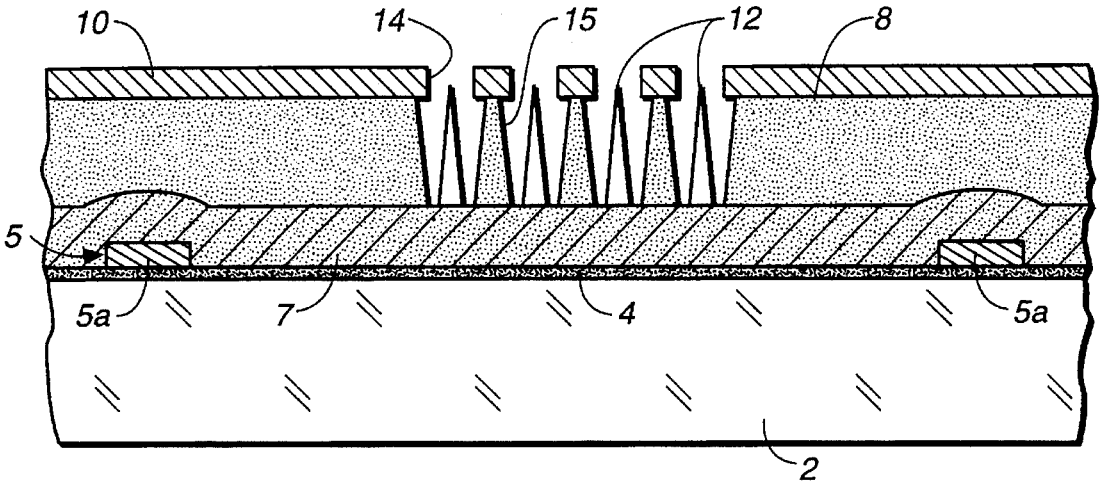
FIG. 1B (PRIOR ART)
Figure 2A:
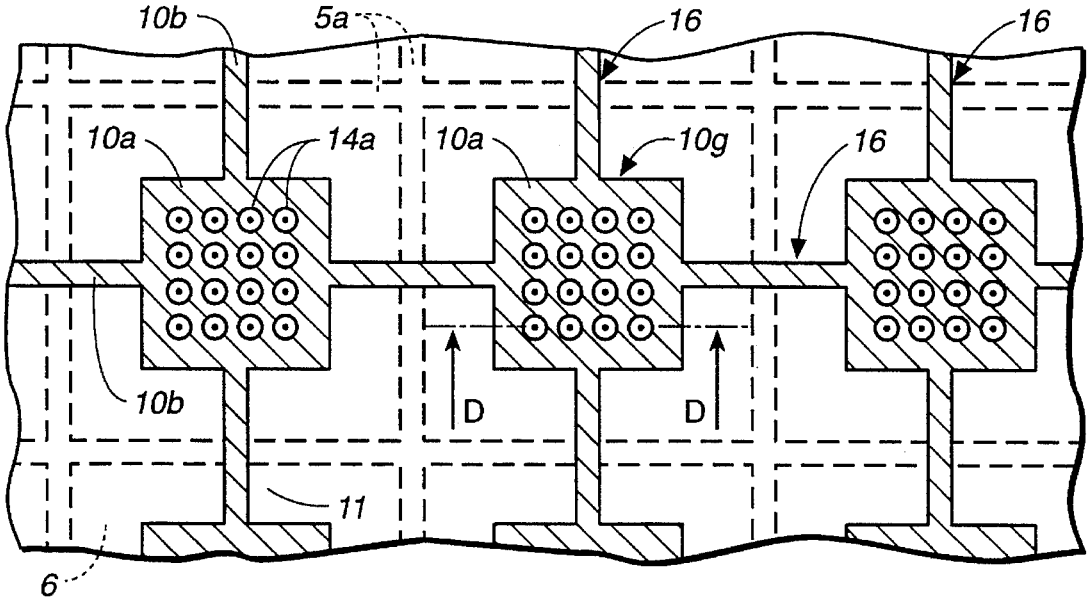
FIGS. 2A and 2B are respectively, a diagrammatic plan view and a diagrammatic sectional view of a special embodiment of the electron source according to the invention, in which the cathode conductors have a lattice structure, whereas the grids are discontinuous electrodes.
Figure 2B:
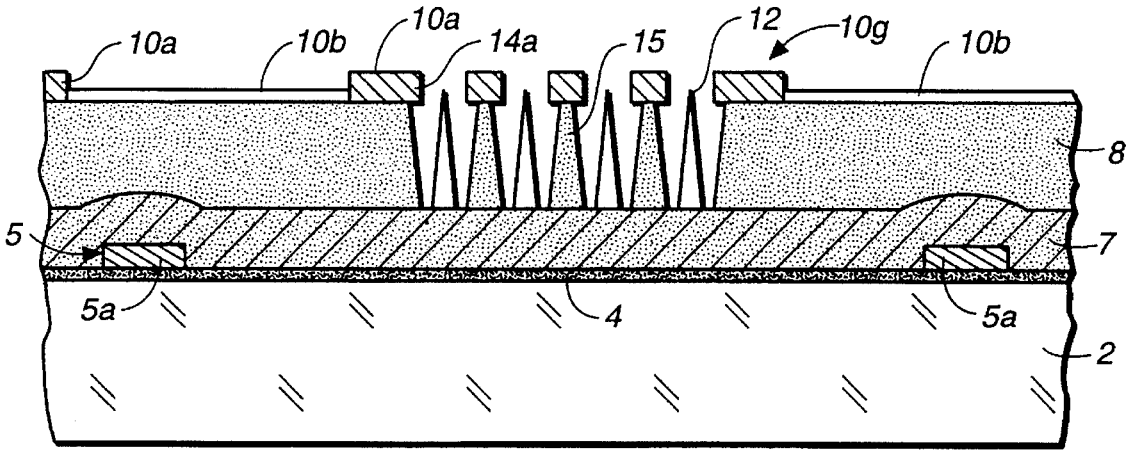

FIG. 2A is a diagrammatic plan view of an electron source according to the invention and FIG. 2B a diagrammatic sectional view along DD of said source. This source according to the invention differs from the known source shown in FIGS. 1A and 1B by the fact that the grids are discontinuous electrodes.

The cathode conductors 5 of the source of FIGS. 2A and 2B have a lattice structure, whereas the grids 10*g* of said source have openings 11, which make the grids discontinuous or perforated. These openings 11 face intersection zones of the conductive tracks 5A of the lattices and are centred on said zones, in plan view, as can be seen in FIG. 2A. Obviously, the grids have the holes 14*a* respectively facing the micropoints 2 of the source.

More specifically, each grid 10*g* of the source in FIGS. 2A and 2B substantially has the structure of a lattice identical to the lattice of the corresponding cathode conductor, but the grid lattice is displaced with respect to the cathode conductor lattice by a half-spacing parallel to the rows and a half-spacing parallel to the columns of the source and, above a zone where the micropoints are located, said grid has, in plan view, a square surface 10*a* perforated by the holes 14*a* and to which lead four tracks 10*b* forming part of the lattice of said grid. This square surface is smaller than the surface of the opening 6 which it faces.

FIG. 2A shows that the overlap zones 16 of the cathode conductor tracks 5*a* and the grid tracks 10*b* facing the same have a very small surface.

In the electron source according to the invention, whereof a sectional view is diagrammatically shown in FIG. 3*b*, the grids have a lattice structure, whereas the cathode conductors form discontinuous electrodes.

More specifically, in the embodiment shown in FIG. 3, each cathode conductor 18 is formed on the layer 4 and is consequently below the resistive layer 7 and has, in plan view, the same shape as the electrode log of FIGS. 2A and 2B, with the exception that said cathode conductor has no hole level with the micropoints carried by the resistive layer 7.

Figure 3:
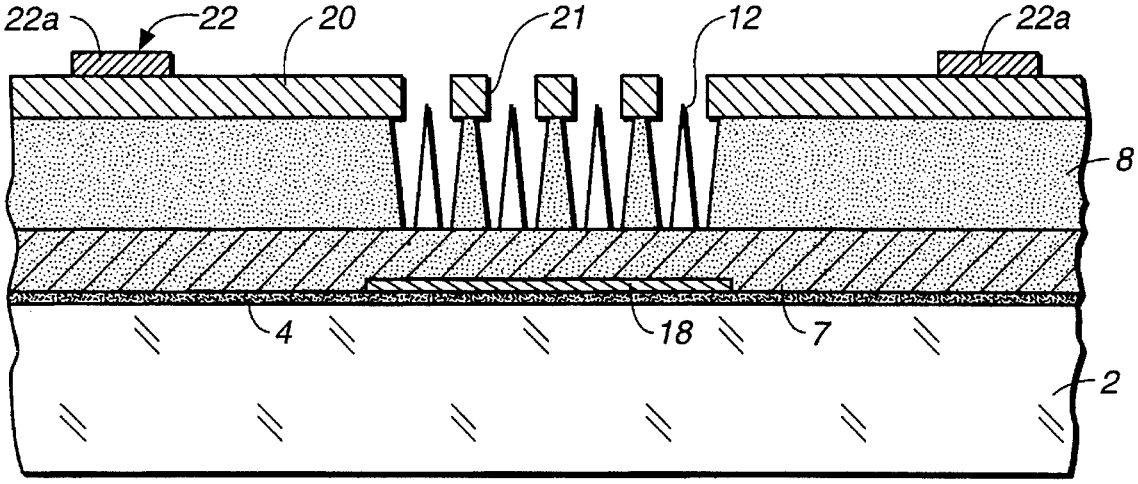
FIG. 3 is a diagrammatic sectional view of another special embodiment of the source according to the invention, in which the cathode conductors form discontinuous electrodes, whereas the grids have a lattice structure.

In the case of FIG. 3, a resistive layer 20 is formed on the insulating layer 8 and is provided with holes 21 facing the micropoints in order to permit the passage of the electrons emitted by the latter during the excitation of the source. The grid 22 corresponding to the cathode conductor log is formed on said resistive layer 20 and has a lattice structure, whose tracks 22*a* are shown in section in FIG. 3.

Obviously, as in the case of the source described in document (3), each lattice structure conductor can be positioned either above the corresponding resistive layer (case of FIG. 3) or below said resistive layer (case of FIG. 2*b*).

Compared with the source known from document (3), a source according to the invention has the essential advantage of reducing the short-circuit probability between the rows and columns of the source and consequently improves the source manufacturing efficiency.

A source according to the invention has a further significant advantage. It makes it possible to reduce the capacitance between the rows and the columns in a proportion substantially identical to that of the reduction of the surface of the electrode which is made discontinuous. This is very important, because the reduction of said capacity makes it possible to reduce the electrical power consumption of a cathodoluminescence display means (more simply referred to as a cathodoluminescent screen) produced with a micropoint electron source, a significant part of said power consumption being the capacitive power consumption of the electron source.

An explanation will be given hereinafter of a significant supplementary advantage provided by the source according to the invention.

Figure 4:
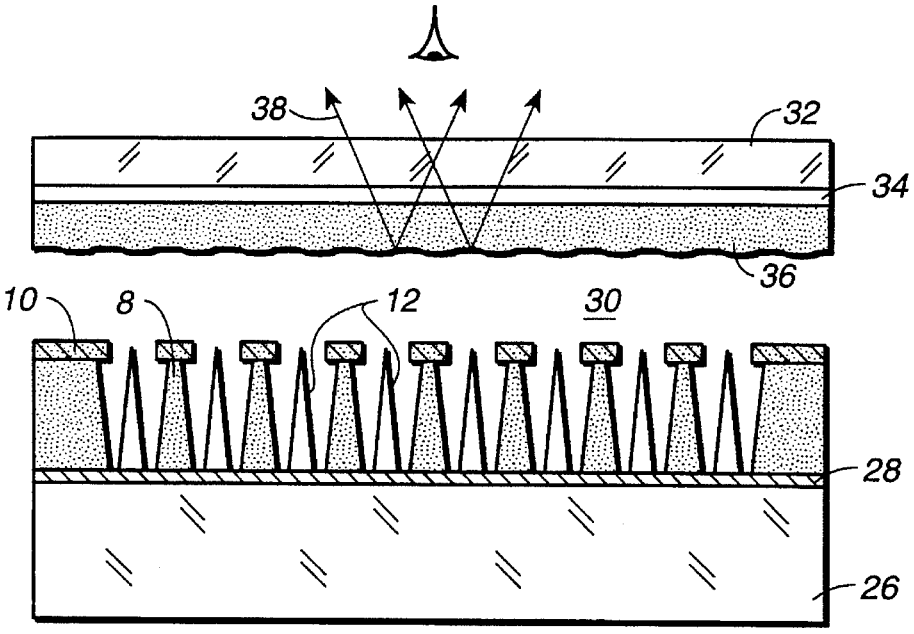
FIG. 4 is a diagrammatic sectional view of a known cathodoluminescence display means, whose cathodoluminescent material is observed from the side opposite to its excitation.

A known cathodoluminescent screen is diagrammatically shown in section in FIG. 4. This known screen has a micropoint electron source 24, whereof it is possible to see the insulating substrate 26, the resistive layer 28, the micropoints 12, the insulating layer 8 and a grid 10.

A space 80 in which is formed a vacuum separates said micropoint source 24 from an electrically insulating, transparent substrate 32, which is provided with a transparent, electrically conductive layer 34 forming an anode. The latter is positioned facing the micropoint source 24 and is coated, in front of said source, by a cathodoluminescent material layer 16 also referred to as a luminophor.

Under the impact of electrons emitted by the micropoints when the source is functioning, said layer 36 emits light 38, which a screen user 40 observes through the transparent substrate 32. Thus, with the known screen, the luminophor is observed from the side opposite to its excitation.

Figure 5:
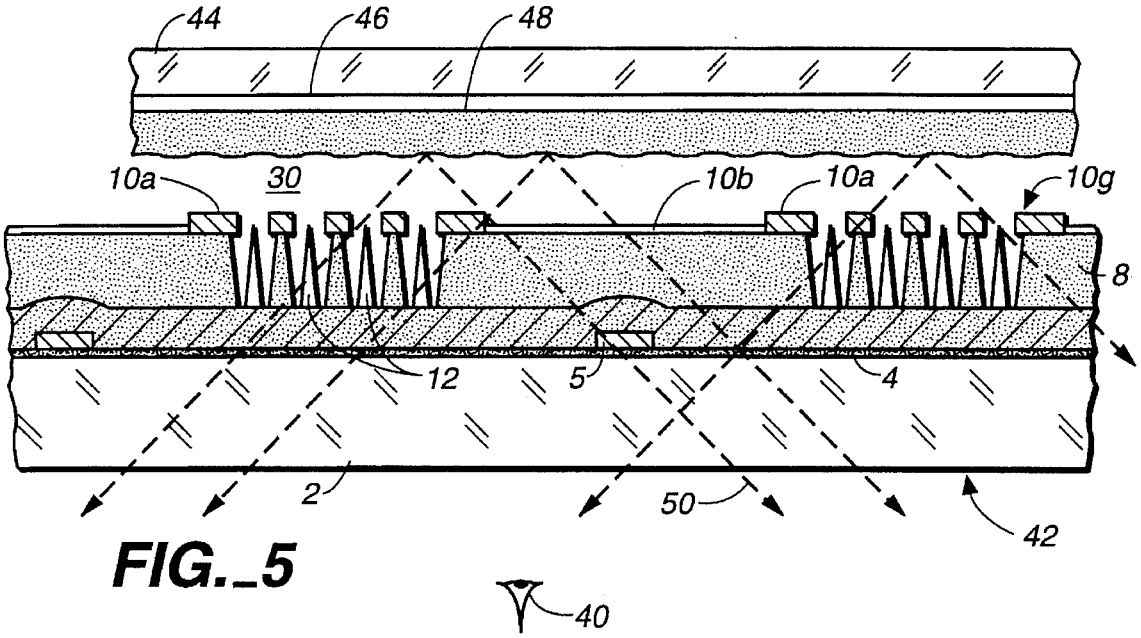
FIG. 5 is a diagrammatic sectional view of a cathodoluminescence display means according to the invention, whose cathodoluminescent material is observed from the excitation side of said material.

Consideration will now be given to a screen according to the invention as shown in FIG. 5 and which comprises an electron source 42, e.g. of the type shown in FIGS. 2A and 2B and whereof it is possible to see the substrate 2, the silica layer 4, a cathode conductor 5, the resistive layer 7, the insulating layer 8, the micropoints 12 and a grid log.

Facing said source 42 there is an electrically insulating substrate 44 coated with a conductive layer 46, itself coated with a luminophor layer 48 facing the micropoint source 42, an air-empty space 80 being provided between the source 42 and the layer 48.

The supplementary advantage is that if the resistive layer 7 is transparent to the light 50 emitted by the luminophors 48 and the impact of the electrons from the micropoints 12, which is obtained by e.g. making the resistive layer of $SnO_2$, whereas the electron source 42 according to the invention can have a high transmission coefficient, higher than 50%, with respect to said light 50.

In this case, it is possible to produce a new screen structure in which the luminophor 48 is observed from its excitation side through the micropoint source (the silica layers 4 and 8 being transparent to the light 50 and the substrate 2 being e.g. made from glass so as to be also transparent). This also makes it possible to improve the luminous efficiency of the screen and consequently lower its electric power consumption. In this case, it is preferable to choose for the conductive layer 46 a layer able to reflect the light 50 emitted by the luminophor.

Figure 6:
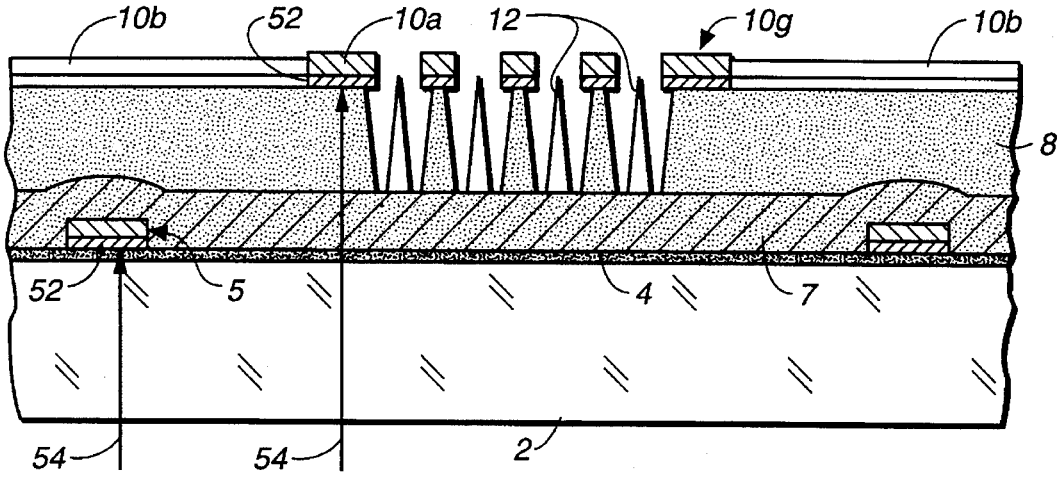
FIG. 6 is a partial, diagrammatic view of a cathodoluminescence display means according to the invention, whose cathode conductors and grids are provided with adsorbing underlayers.

In the case of a screen according to the invention, which is observable through its electron source, each cathode conductor and each grid are preferably formed on an underlayer 52 able to adsorb the light 54 outside the screen, as shown in the embodiment of FIG. 6. This makes it possible to improve the contrast of the screen illuminated by said light 54.

Therefore the said external light 54 is adsorbed instead of being reflected towards the observer.

Hereinafter is given as a purely indicative and in no way limitative example with reference to FIGS. 7A, 7B and 7C, numerical values relative to improvements provided by the invention compared with known micropoint electron sources.

Figure 7A:
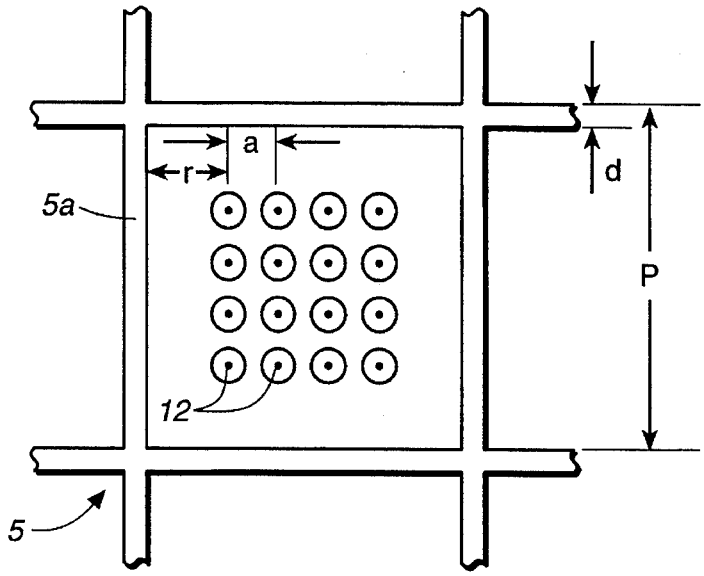
FIGS. 7A, 7B and 7C are partial and diagrammatic views showing the structures of a cathode conductor of a grid and an emissive cathode forming part of a source according to the invention.

In the embodiment of FIG. 7A, it is possible to see a cathode conductor 5 with a lattice structure and having meshes with a spacing p of 25 micrometers. The width d of the conductive tracks 5*a* forming the lattice is 2 micrometers. A system of 16 micropoints 12 is formed in the centre of the lattice meshes. The distance a between two micropoints is 3 micrometers. The distance r between the micropoint system and the tracks is 7 micrometers.

Figure 7B:
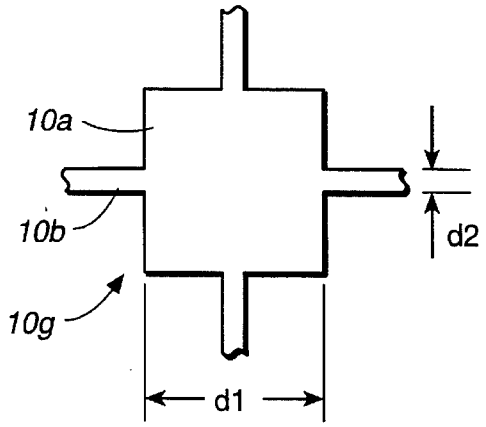
Figure 7C:
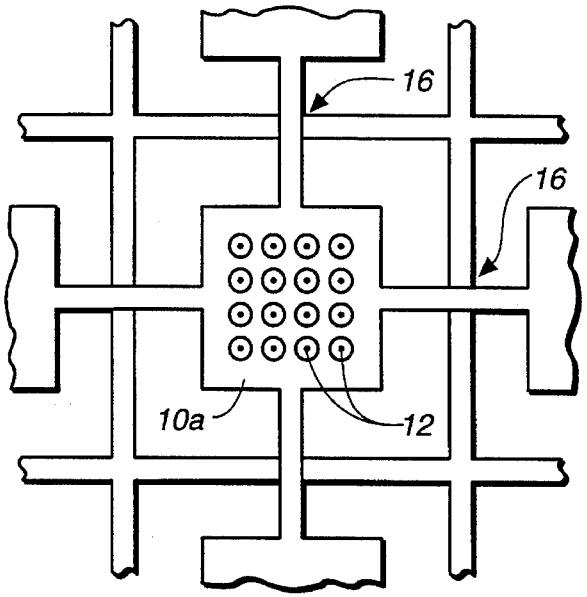

The grid 10*g* associated with the cathode conductor 8 and which can be seen in FIG. 7B has a perforated surface and said grid has square conductors 10*a*, whereof the sides d1 are 11 micrometers and which are positioned in the centre of the lattice meshes so as to cover the micropoint systems. All the square conductors are interconnected by conductive tracks 10*b*, whose width d2 is 2 micrometers.

In the embodiment shown, each square conductor is supplied by four conductive tracks, which leads to a very limited probability of having an unsupplied square conductor.

The following comments are made in connection with the numerical example given in non-limitative manner hereinbefore. For each mesh, the surface of the overlap zone 16 between a cathode conductor and the corresponding grid (FIG. 7C) is 4×4 micrometers$^2$, i.e. 16 micrometers, instead of 200 micrometers$^2$ in a source known from document (3). In this case the probability of having a short-circuit is reduced by a coefficient greater than 10 as a result of the present invention.

The surface covered by the grid is (11×11) +(2×14), i.e. approximately 150 micrometers$^2$ in meshes of 25×25=625 micrometers$^2$.

Therefore the grid surface is reduced by a coefficient greater than 4 compared with a source described in document (3).

Therefore the capacitance between the rows and columns is essentially divided by 4, which reduces the capacitive consumption by the same amount.

In the numerical example given hereinbefore, the transmission of a grid is approximately 75% and the transmission of a cathode conductor is approximately 85%. Consequently, with a transparent resistive layer, the transmission of the electron source is approximately 60%, which makes it possible to manufacture a screen for which the luminophor is advantageously observed from the side of its excitation through the electron source.

In this case, the lattice structure cathode conductors and the perforated grids are advantageously formed on an absorbing layer in order to improve the contrast under lumination. This adsorbing layer is e.g. formed by a black chromium film with a thickness of a few dozen nanometres.

We claim:

1. An apparatus comprising:

an electrically insulating support;

a resistive layer formed on the electrically insulating support;

a plurality of microtips made from an electron emitting material and formed in contact with the resistive layer;

a first series Of electrodes formed in contact with the resistive layer and serving as cathode conductors; and a second series of electrodes serving as grids, the second series of electrodes being electrically insulated from the first series of electrodes; wherein:

the first series of electrodes is formed by a first plurality of parallel conductors and a second plurality of parallel conductors intersecting the first plurality of parallel conductors;

the second series of electrodes is formed by a third plurality of conductors each extending in one direction and periodically having narrow portions and wide portions, and a fourth plurality of conductors intersecting the third plurality of conductors and each extending in another direction and periodically having narrow portions and wide portions, the wide portions of the third conductors and the wide portions of the fourth conductors being merged;

the second series of electrodes is positioned with the narrow portions of the third and fourth plurality of conductors overlapping the first and second plurality of conductors of the first series of electrodes.

2. An apparatus comprising:

an electrically insulating support;

a first series of electrodes formed on the insulating support and serving as cathode conductors;

a plurality of microtips made from an electron emitting material and formed on the first series of electrodes; and a second series of electrodes serving as grids, the second series of electrodes being electrically insulated from the first series of electrodes and formed in contact with a resistive layer; wherein:

the second series of electrodes is formed by a first plurality of parallel conductors and a second plurality of parallel conductors intersecting the first plurality of parallel conductors;

the first series of electrodes is formed by a third plurality of conductors each extending in one direction and periodically having narrow portions and wide portions, and a fourth plurality of conductors intersecting the third plurality of conductors and each extending in another direction and periodically having narrow portions and wide portions, the wide portions of the third conductors and the wide portions of the fourth conductors being merged; and the first series of electrodes is positioned with the narrow portions of the third and fourth plurality of conductors overlapping the first and second plurality of conductors of the second series of electrodes.

3. A cathodoluminescent display apparatus comprising:

an electrically insulating support;

a first series of electrodes formed on the insulating support and serving as cathode conductors;

a plurality of microtips made from an electron emitting material and formed on the first series of electrodes;

a second series of electrodes serving as grids, the second series of electrodes being electrically insulated from the first series of electrodes; and an anode disposed opposite said microtips and having a layer of cathodoluminescent material that emits light under the impact of electrons emitted by said electron emitting material; wherein:

one of the first series of electrodes and the second series of electrodes supporting a resistive layer and being formed by a first plurality of parallel conductors and a second plurality of parallel conductors intersecting the first plurality of parallel conductors; these series of electrodes supporting a resistive layer;

another of the first series of electrodes and the second series of electrodes is formed by a third plurality of conductors each extending in one direction and periodically having narrow portions and wide portions, and a fourth plurality of conductors intersecting the third plurality of conductors and each extending in another direction and periodically having narrow portions and wide portions, the wide portions of the third conductors and the wide portions of the fourth conductors being merged;

the other series of electrodes is positioned with the narrow portions of the third and fourth plurality of conductors overlapping the first and second plurality of conductors of the one series of electrodes.

4. The apparatus of claim 2, wherein said resistive layer and said support are at least partially transparent to light emitted by said cathodoluminescent layer to allow observation of said cathodoluminescent layer through said support.

5. The apparatus of claim 2, wherein said anode comprises an electrode having a surface opposite said microtips that reflects said light emitted by said cathodoluminescent layer, and said cathodoluminescent layer is formed on said surface.

6. The apparatus of claim 2, further comprising material layered beneath electrodes of both said first and second series for absorbing light entering the apparatus from outside the apparatus and incident on said material.

7. The apparatus of claim 1, wherein a resistive layer is formed between the first series of electrodes and the microtips.

* * * * *